US005405682A

United States Patent [19]

Shawyer et al.

[11] Patent Number: 5,405,682

[45] Date of Patent: Apr. 11, 1995

[54] NONWOVEN FABRIC MADE WITH MULTICOMPONENT POLYMERIC STRANDS INCLUDING A BLEND OF POLYOLEFIN AND ELASTOMERIC THERMOPLASTIC MATERIAL

[75] Inventors: Susan E. Shawyer, Roswell; Linda A. Connor, Atlanta; Paul W. Estey, Cumming; Jay S. Shultz, Roswell; David C. Strack, Canton, all of Ga.

[73] Assignee: Kimberly Clark Corporation, Neenah, Wis.

[21] Appl. No.: 935,769

[22] Filed: Aug. 26, 1992

[51] Int. Cl.[6] ..... D03D 3/00

[52] U.S. Cl. ..... 428/221; 428/224; 428/288; 428/373

[58] Field of Search ..... 428/373, 224, 288, 221

[56] References Cited

U.S. PATENT DOCUMENTS

| | | | |
|---|---|---|---|
| Re. 30,955 | 6/1982 | Stanistreet | 156/308.2 |
| Re. 31,825 | 2/1985 | Mason et al. | 428/198 |
| 2,931,091 | 4/1960 | Breen | 28/82 |
| 2,987,797 | 6/1961 | Breen | 28/82 |
| 3,038,235 | 6/1962 | Zimmerman | 28/82 |
| 3,038,236 | 6/1962 | Breen | 28/82 |
| 3,038,237 | 6/1962 | Taylor, Jr. | 28/82 |
| 3,377,232 | 4/1968 | Meacock et al. | 161/155 |
| 3,423,266 | 1/1969 | Davies et al. | 156/167 |
| 3,551,271 | 12/1970 | Thomas et al. | 161/150 |
| 3,589,956 | 6/1971 | Kranz et al. | 156/62.4 |
| 3,595,731 | 7/1971 | Davies et al. | 161/150 |
| 3,616,160 | 10/1971 | Wincklhofer | 161/150 |
| 3,692,618 | 9/1972 | Dorschner et al. | 161/72 |
| 3,725,192 | 4/1973 | Ando et al. | 161/175 |
| 3,760,046 | 9/1973 | Schwartz et al. | 264/47 |
| 3,802,817 | 4/1974 | Matsuki et al. | 425/66 |
| 3,824,146 | 7/1974 | Ellis | 161/150 |
| 3,855,045 | 12/1974 | Brock | 161/146 |
| 3,895,151 | 7/1975 | Matthews et al. | 428/102 |
| 3,900,678 | 8/1975 | Aishima et al. | 428/374 |
| 3,940,302 | 2/1976 | Matthews et al. | 156/167 |

(List continued on next page.)

FOREIGN PATENT DOCUMENTS 612156 1/1961 Canada .

(List continued on next page.)

OTHER PUBLICATIONS

"Thermobonding Fibers for Nonwovens" by S. Tomioka, Nonwovens Industry, May 1981, pp. 23–31.

"The Effects of Processing on the Mechanical Properties of a Polyolefin Blend", By V. Flaris et al., Polymer International, vol. 27, pp. 267–273 (1992).

"Use of Thermoplastic Rubbers In Blends With Other Plastics", Bull et al., The Journal of Elastomerics and Plastics, vol. 9, Jul. 1977.

"Morphology Of Polyethylene Blends: I. From spheres to fibrils & extended co-continuous phases in blends of polyethylene with styrene-isoprene-styrene triblock copolymers", C. David et al. Polymer, 1991, vol. 32, No. 3.

"Ternary Polyolefin Blends With Styrenic Block Copolymers", L. A. Pottick et al., Society of Plastics Engineers Conference, 1991.

KRATON Thermoplastic rubber product description.

*Primary Examiner*—James J. Bell

*Attorney, Agent, or Firm*—Michael U. Lee; William D. Herrick

[57] ABSTRACT

A nonwoven fabric made with multicomponent polymeric strands includes a blend of a polyolefin and elastomeric thermoplastic material in one side or the sheath of the multicomponent polymeric strands. The fabric has improved abrasion resistance and comparable strength and softness properties. The thermoplastic elastomeric copolymer is preferably A-B-A′ block copolymer wherein A and A′ are each a thermoplastic endblock which includes a styrenic moiety and wherein B is an elastomeric poly(ethylene-butylene) mid block. Composite materials including such multicomponent material bonded to both sides of an inner meltblown layer are also disclosed.

33 Claims, 3 Drawing Sheets

U.S. PATENT DOCUMENTS

| | | | |
|---|---|---|---|
| 3,992,499 | 11/1976 | Lee | 264/78 |
| 4,005,169 | 1/1977 | Cumbers | 264/103 |
| 4,068,036 | 1/1978 | Stanistreet | 428/296 |
| 4,076,698 | 2/1978 | Anderson et al. | 526/348.6 |
| 4,086,112 | 4/1978 | Porter | 156/73.1 |
| 4,088,726 | 5/1978 | Cumbers | 264/123 |
| 4,119,447 | 10/1978 | Ellis et al. | 156/73.1 |
| 4,154,357 | 5/1979 | Sheard et al. | 220/88 A |
| 4,170,680 | 10/1979 | Cumbers | 428/195 |
| 4,181,762 | 1/1980 | Benedyk | 428/97 |
| 4,188,436 | 2/1980 | Ellis et al. | 428/198 |
| 4,189,338 | 2/1980 | Ejima et al. | 156/167 |
| 4,195,112 | 3/1980 | Sheard et al. | 428/288 |
| 4,211,816 | 7/1980 | Booker et al. | 428/296 |
| 4,211,819 | 7/1980 | Kunimune et al. | 428/374 |
| 4,216,772 | 8/1980 | Tsuchiya et al. | 128/284 |
| 4,234,655 | 11/1980 | Kunimune et al. | 428/374 |
| 4,258,097 | 3/1981 | Benedyk | 428/224 |
| 4,269,888 | 5/1981 | Ejima et al. | 428/296 |
| 4,285,748 | 8/1981 | Booker et al. | 156/167 |
| 4,306,929 | 12/1981 | Menikheim et al. | 156/290 |
| 4,315,881 | 2/1982 | Nakajima et al. | 264/171 |
| 4,323,626 | 4/1982 | Kunimune et al. | 427/374 |
| 4,340,563 | 7/1982 | Appel et al. | 264/518 |
| 4,356,220 | 10/1982 | Benedyk | 428/17 |
| 4,362,777 | 12/1982 | Miller | 428/224 |
| 4,369,156 | 1/1983 | Mathes et al. | 264/147 |
| 4,373,000 | 2/1983 | Knoke et al. | 428/198 |
| 4,381,326 | 4/1983 | Kelly | 428/134 |
| 4,396,452 | 8/1983 | Menikheim et al. | 156/290 |
| 4,419,160 | 12/1983 | Wang et al. | 156/73.2 |
| 4,434,204 | 2/1984 | Hartman et al. | 428/198 |
| 4,451,520 | 5/1984 | Tecl et al. | 428/198 |
| 4,469,540 | 9/1984 | Furukawa et al. | 156/62.4 |
| 4,477,516 | 10/1984 | Sugihara et al. | 428/296 |
| 4,480,000 | 10/1984 | Watanabe et al. | 428/284 |
| 4,483,897 | 11/1984 | Fujimura et al. | 428/288 |
| 4,485,141 | 11/1984 | Fujimura et al. | 428/288 |
| 4,496,508 | 1/1985 | Hartman et al. | 264/167 |
| 4,500,384 | 2/1985 | Tomioka et al. | 156/290 |
| 4,504,539 | 3/1985 | Petracek et al. | 428/195 |
| 4,511,615 | 4/1985 | Ohta | 428/198 |
| 4,520,066 | 5/1985 | Athey | 428/288 |
| 4,530,353 | 7/1985 | Lauritzen | 128/156 |
| 4,546,040 | 10/1985 | Knotek et al. | 428/370 |
| 4,547,420 | 10/1985 | Krueger et al. | 428/229 |
| 4,551,378 | 11/1985 | Carey, Jr. | 428/198 |
| 4,552,603 | 11/1985 | Harris, Jr. et al. | 156/167 |
| 4,555,430 | 11/1985 | Mays | 428/134 |
| 4,555,811 | 12/1985 | Shimalla | 2/81 |
| 4,557,972 | 12/1985 | Okamoto et al. | 428/373 |
| 4,588,630 | 5/1986 | Shimalla | 428/131 |
| 4,595,629 | 6/1986 | Mays | 428/286 |
| 4,632,858 | 12/1986 | Knoke et al. | 428/287 |
| 4,644,045 | 2/1987 | Fowells | 526/348 |
| 4,656,075 | 4/1987 | Mudge | 428/110 |
| 4,657,804 | 4/1987 | Mays et al. | 428/212 |
| 4,663,220 | 5/1987 | Wisneski et al. | 428/221 |
| 4,681,801 | 7/1987 | Eian et al. | 428/283 |
| 4,684,570 | 8/1987 | Malaney | 428/296 |
| 4,713,134 | 12/1987 | Mays et al. | 156/181 |
| 4,713,291 | 12/1987 | Sasaki et al. | 428/373 |
| 4,722,857 | 2/1988 | Tomioka et al. | 428/113 |
| 4,731,277 | 3/1988 | Groitzsch et al. | 428/137 |
| 4,737,404 | 4/1988 | Jackson | 428/284 |
| 4,749,423 | 6/1988 | Vaalburg et al. | 156/181 |
| 4,755,179 | 7/1988 | Shiba et al. | 604/370 |
| 4,756,786 | 7/1988 | Malaney | 156/308.2 |
| 4,770,925 | 9/1988 | Uchikawa et al. | 428/219 |
| 4,774,124 | 9/1988 | Shimalla et al. | 428/171 |
| 4,774,277 | 9/1988 | Janac et al. | 524/474 |
| 4,787,947 | 11/1988 | Mays | 156/160 |
| 4,789,699 | 12/1988 | Kieffer et al. | 524/271 |
| 4,795,559 | 1/1989 | Shinjou et al. | 210/490 |
| 4,795,668 | 1/1989 | Krueger et al. | 428/174 |
| 4,804,577 | 2/1989 | Hazelton et al. | 428/224 |
| 4,808,202 | 2/1989 | Nishikawa et al. | 55/390 |
| 4,814,032 | 3/1989 | Taniguchi et al. | 156/167 |
| 4,818,587 | 4/1989 | Ejima et al. | 428/198 |
| 4,830,904 | 5/1989 | Gessner et al. | 428/219 |
| 4,839,228 | 6/1989 | Jezic et al. | 428/401 |
| 4,840,846 | 6/1989 | Ejima et al. | 428/373 |
| 4,840,847 | 6/1989 | Ohmae et al. | 428/373 |
| 4,851,284 | 7/1989 | Yamanoi et al. | 428/284 |
| 4,872,870 | 10/1989 | Jackson | 604/366 |
| 4,874,447 | 10/1989 | Hazelton et al. | 156/167 |
| 4,874,666 | 10/1989 | Kubo et al. | 428/398 |
| 4,880,691 | 11/1989 | Sawyer et al. | 428/225 |
| 4,883,707 | 11/1989 | Newkirk | 428/219 |
| 4,909,975 | 3/1990 | Sawyer et al. | 264/210.7 |
| 4,966,808 | 10/1990 | Kawano | 428/224 |
| 4,981,749 | 1/1991 | Kubo et al. | 428/219 |
| 4,997,611 | 3/1991 | Hartmann | 264/210.8 |
| 5,001,813 | 3/1991 | Rodini | 19/0.46 |
| 5,002,815 | 3/1991 | Yamanaka et al. | 428/109 |
| 5,068,141 | 11/1991 | Kubo et al. | 428/219 |
| 5,069,970 | 12/1991 | Largman et al. | 428/373 |
| 5,082,720 | 1/1992 | Hayes | 428/224 |
| 5,108,276 | 4/1992 | Hartmann | 425/66 |
| 5,108,820 | 4/1992 | Kaneko et al. | 428/198 |
| 5,108,827 | 4/1992 | Gessner | 428/219 |
| 5,125,818 | 6/1992 | Yeh | 425/131.5 |
| 5,126,201 | 6/1992 | Shiba et al. | 428/389 |

FOREIGN PATENT DOCUMENTS

| | | |
|---|---|---|
| 618040 | 4/1961 | Canada . |
| 769644 | 10/1967 | Canada . |
| 792651 | 8/1968 | Canada . |
| 829845 | 12/1969 | Canada . |
| 846761 | 7/1970 | Canada . |
| 847771 | 7/1970 | Canada . |
| 852100 | 9/1970 | Canada . |
| 854076 | 10/1970 | Canada . |
| 896214 | 3/1972 | Canada . |
| 903582 | 6/1972 | Canada . |
| 959221 | 12/1974 | Canada . |
| 959225 | 12/1974 | Canada . |
| 1051161 | 3/1979 | Canada . |
| 1058818 | 7/1979 | Canada . |
| 1060173 | 8/1979 | Canada . |
| 1071943 | 2/1980 | Canada . |
| 1081905 | 7/1980 | Canada . |
| 1103869 | 6/1981 | Canada . |
| 1109202 | 9/1981 | Canada . |
| 1128411 | 7/1982 | Canada . |
| 1133771 | 10/1982 | Canada . |
| 1140406 | 2/1983 | Canada . |
| 1143930 | 4/1983 | Canada . |
| 1145213 | 4/1983 | Canada . |
| 1145515 | 5/1983 | Canada . |
| 1148302 | 6/1983 | Canada . |
| 1172814 | 8/1984 | Canada . |
| 1174039 | 9/1984 | Canada . |
| 1175219 | 10/1984 | Canada . |
| 1178524 | 11/1984 | Canada . |
| 1182692 | 2/1985 | Canada . |
| 1204641 | 5/1986 | Canada . |
| 1208098 | 7/1986 | Canada . |
| 1218225 | 2/1987 | Canada . |
| 1226486 | 9/1987 | Canada . |
| 1230720 | 12/1987 | Canada . |
| 1230810 | 12/1987 | Canada . |
| 1234535 | 3/1988 | Canada . |
| 1235292 | 4/1988 | Canada . |
| 1237884 | 6/1988 | Canada . |
| 1250412 | 2/1989 | Canada . |
| 1257768 | 7/1989 | Canada . |
| 1259175 | 9/1989 | Canada . |
| 1267273 | 4/1990 | Canada . |
| 2001091 | 4/1990 | Canada . |
| 1272945 | 8/1990 | Canada . |
| 1273188 | 8/1990 | Canada . |
| 2011599 | 9/1990 | Canada . |

NONWOVEN FABRIC MADE WITH MULTICOMPONENT POLYMERIC STRANDS INCLUDING A BLEND OF POLYOLEFIN AND ELASTOMERIC THERMOPLASTIC MATERIAL

TECHNICAL INFORMATION

This invention generally relates to polymeric fabrics, and more particularly relates to multicomponent nonwoven polymeric fabrics.

BACKGROUND OF THE INVENTION

Nonwoven fabrics are used to make a variety of products, which desirably have particular levels of softness, strength, durability, uniformity, liquid handling properties such as absorbency, liquid barrier properties, and other physical properties. Such products include towels, industrial wipes, incontinence products, infant care products such as baby diapers, absorbent feminine care products and garments such as medical apparel. These products are often made with multiple layers of nonwoven fabric to obtain the desired combination of properties. For example, disposable baby diapers made from nonwoven fabrics may include a liner layer which fits next to the baby's skin and is soft, strong and porous, an impervious outer cover layer which is strong and soft, and one or more interior liquid handling layers which are soft and absorbent.

Nonwoven fabrics such as the foregoing are commonly made by melt spinning thermoplastic materials. Such fabrics are called spunbond materials and methods for making spunbond polymeric materials are well-known. U.S. Pat. No. 4,692,618 to Dorschner et al. and U.S. Pat. No. 4,340,563 to Appel et al. both disclose methods for making spunbond nonwoven webs from thermoplastic materials by extruding the thermoplastic material through a spinneret and drawing the extruded material into filaments with a stream of high velocity air to form a random web on a collecting surface. For example, U.S. Pat. No. 3,692,618 to Dorschner et al. discloses a process wherein bundles of polymeric filaments are drawn with a plurality of eductive guns by very high speed air. U.S. Pat. No. 4,340,563 to Appel et al. discloses a process wherein thermoplastic filaments are drawn through a single wide nozzle by a stream of high velocity air. The following patents also disclose typical melt spinning processes: U.S. Pat. No. 3,338,992 to Kinney; U.S. Pat. No. 3,341,394 to Kinney; U.S. Pat. No. 3,502,538 to Levy; U.S. Pat. No. 3,502,763 to Hartmann; U.S. Pat. No. 3,909,009 to Hartmann; U.S. Pat. No. 3,542,615 to Dobo et al.; and Canadian Patent Number 803,714 to Harmon.

Spunbond materials with desirable combinations of physical properties, especially combinations of softness, strength and durability, have been produced, but limitations have been encountered. For example, for some applications, polymeric materials such as polypropylene may have a desirable level of strength but not a desirable level of softness. On the other hand, materials such as polyethylene may, in some cases, have a desirable level of softness but not a desirable level of strength.

In an effort to produce nonwoven materials having desirable combinations of physical properties, multicomponent or bicomponent nonwoven fabrics have been developed. Methods for making bicomponent nonwoven materials are well-known and are disclosed in patents such as Reissue Number 30,955 of U.S. Pat. No. 4,068,036 to Stanistreet, U.S. Pat. No. 3,423,266 to Davies et al., and U.S. Pat. No. 3,595,731 to Davies et al. A bicomponent nonwoven fabric is made from polymeric fibers or filaments including first and second polymeric components which remain distinct. As used herein, filaments mean continuous strands of material and fibers mean cut or discontinuous strands having a definite length. The first and second components of multicomponent filaments are arranged in substantially distinct zones across the cross-section of the filaments and extend continuously along the length of the filaments. Typically, one component exhibits different properties than the other so that the filaments exhibit properties of the two components. For example, one component may be polypropylene which is relatively strong and the other component may be polyethylene which is relatively soft. The end result is a strong yet soft nonwoven fabric.

U.S. Pat. No. 3,423,266 to Davies et al. and U.S. Pat. No. 3,595,731 to Davies et al. disclose methods for melt spinning bicomponent filaments to form nonwoven polymeric fabrics. The nonwoven webs may be formed by cutting the meltspun filaments into staple fibers and then forming a bonded carded web or by laying the continuous bicomponent filaments onto a forming surface and thereafter bonding the web.

To increase the bulk of the bicomponent nonwoven webs, the bicomponent fibers or filaments are often crimped. As disclosed in U.S. Pat. Nos. 3,595,731 and 3,423,266 to Davies et al., bicomponent filaments may be mechanically crimped and the resultant fibers formed into a nonwoven web or, if the appropriate polymers are used, a latent helical crimp produced in bicomponent fibers or filaments may be activated by heat treatment of the formed web. The heat treatment is used to activate the helical crimp in the fibers or filaments after the fiber or filaments have been formed into a nonwoven web.

Particularly for outer cover materials such as the outer cover layer of a disposable baby diaper, it is desirable to improve the durability of nonwoven fabric while maintaining high levels of softness. The durability of nonwoven fabric can be improved by increasing the abrasion resistance of the fabric. The abrasion resistance may be increased by increasing the give of the fabric. For example, with multicomponent nonwoven fabrics including a softer component such as polyethylene and a high strength component such as polypropylene, the bonds between the multicomponent strands tend to pull apart when subjected to a load. To produce a more durable fabric, it is desirable to increase the durability of the bonds between such multicomponent polymeric strands.

Therefore, there is a need for a nonwoven fabric which has enhanced levels of softness and durability, particularly for uses such as an outer cover material for personal care articles and garment material.

SUMMARY OF THE INVENTION

Accordingly, an object of the present invention is to provide improved nonwoven fabrics and methods for making the same.

Another object of the present invention is to provide nonwoven fabrics with desirable combinations of physical properties such as softness, strength, durability, uniformity and absorbency and methods for making the same.

A further object of the present invention is to provide a soft yet durable nonwoven outer cover material for absorbent personal care products such as disposable baby diapers.

Another object of the present invention is to provide a soft yet durable nonwoven garment material for items such as medical apparel.

Thus, the present invention provides a nonwoven fabric comprising multicomponent polymeric strands wherein one component includes a blend of a polyolefin and a thermoplastic elastomeric polymer. With the addition of the thermoplastic elastomeric polymer the bonds between the strands of the fabric tend not to debond as easily and the abrasion resistance of the fabric is enhanced. More specifically, the thermoplastic elastomeric polymer increases the give of the strands of the fabric at their bond points so that the fabric has more give and a higher abrasion resistance. At the same time, the thermoplastic elastomeric polymer does not diminish the softness of the fabric. When properly bonded the nonwoven fabric of the present invention is particularly suited for use as an outer cover material in personal care products such as disposable baby diapers or for use as a garment material. The fabric of the present invention may be laminated to a film of polymeric material such as polyethylene when used as an outer cover material.

More particularly, the nonwoven fabric of the present invention comprises extruded multicomponent polymeric strands including first and second polymeric components arranged in substantially distinctive zones across the cross-section of the multicomponent strands and extending continuously along the length of the multicomponent strands. The second component of the strands constitutes at least a portion of the peripheral surface of the multicomponent strands continuously along the length of the multicomponent strands and includes a blend of a polyolefin and a thermoplastic elastomeric polymer. Bonds between the multicomponent strands may be formed by the application of heat. As explained above, the addition of the thermoplastic elastomeric polymer enhances the give of the bonds between the multicomponent strands.

More particularly, the thermoplastic elastomeric polymer preferably comprises an A-B-A′ triblock copolymer wherein A and A′ are each a thermoplastic endblock comprising a styrenic moiety and B is an elastomeric poly(ethylene-butylene) midblock. The thermoplastic elastomeric polymer could also further comprise an A-B diblock copolymer wherein A is a thermoplastic endblock comprising a styrenic moiety and B is an elastomeric poly(ethylene-butylene) block. As discussed in more detail below, a suitable thermoplastic elastomeric polymer or compound for use in the present invention is available from Shell Chemical Company of Houston, Tex. under the trademark KRATON.

Still more particularly, the blend of the second component in the multicomponent strands of the present invention further includes a tackifying resin to improve the bonding of the multicomponent strands. Suitable tackifying resins include hydrogenated hydrocarbon resins and terpene hydrocarbon resins. Alpha-methylstyrene is a particularly suitable tackifying resin. Furthermore, the blend of the second component in the multicomponent strands of the present invention preferably includes a viscosity reducing polyolefin to improve the processability of the multicomponent strands. A particularly suitable viscosity reducing polyolefin is a polyethylene wax. Suitable polyolefins for the blend of the second component in the multicomponent strands of the present invention include polyethylene and copolymers of ethylene and propylene. A particularly suitable polyolefin for the second component includes linear low density polyethylene. Preferably, the second component of the multicomponent strands of the present invention has a melting point less than the melting point of the first component of the multicomponent strands.

The first component preferably comprises a polyolefin but may also comprise other thermoplastic polymers such as polyester or polyamides. Suitable polyolefins for the first component of the multicomponent strands of the present invention include polypropylene, copolymers of propylene and ethylene, and poly(4-methyl-1-pentene). The first and second components can be selected so that the first component imparts strength to the fabric of the present invention while the second component imparts softness. As discussed above, the addition of the thermoplastic elastomeric polymer enhances the abrasion resistance of the fabric by increasing the give of the fabric.

Still more specifically, the first polymeric component of the multicomponent strands of the present invention is present in an amount of from about 20 to about 80% by weight of the strands and the second polymeric component is present in an amount from about 80 to about 20% by weight of the strands. In addition, the thermoplastic elastomeric polymer is preferably present in an amount of from about 5 to about 20% by weight of the second component and the polyolefin is present in the second component in an amount of from about 80 to about 95% by weight of the second component. Furthermore, the blend in the second component preferably comprises from greater than 0 to about 10% by weight of the tackifying resin and from greater than 0 to about 10% by weight of the viscosity reducing polyolefin.

According to another aspect of the present invention, a composite nonwoven fabric is provided. The composite fabric of the present invention includes a first web of extruded multicomponent polymeric strands such as is described above including multicomponent polymeric strands with a blend of a polyolefin and thermoplastic elastomeric polymer in the second component of the multicomponent strands. The composite fabric of the present invention further comprises a second web of extruded polymeric strands, the first and second webs being positioned in laminar surface-to-surface relationship and bonded together to form an integrated fabric. The addition of the thermoplastic elastomeric polymer to the second component of the multicomponent strands of the first web enhances the give of the bond between the first web and the second web. This improves the abrasion resistance of the overall composite.

More particularly, the strands of the second web of the composite of the present invention may be formed by conventional meltblowing techniques. Even more particularly, the strands of the second web preferably include a second blend of a polyolefin and a thermoplastic elastomeric polymer. The presence of thermoplastic elastomeric polymer in the first web and the second web enhances the durability of the bond between the webs and the overall durability of the composite.

Still more particularly, the composite fabric of the present invention preferably further comprises a third web of extruded multicomponent polymeric strands including a first and second polymeric components arranged as in the first web, the second component including a third blend of a polyolefin and a thermoplastic elastomeric polymer. The first web is bonded to one side of the second web and the third web is bonded to the opposite side of the second web. The presence of the thermoplastic elastomeric polymer improves the bonding between the three webs and the overall durability of the composite fabric.

Still further objects and the broad scope of applicability of the present invention will become apparent to those of skill in the art from the details given hereinafter. However, it should be understood that the detailed description of the preferred embodiments of the present invention is given only by way of illustration because various changes and modifications well within the spirit and scope of the invention should become apparent to those of skill in the art in view of the following detailed description.

DETAILED DESCRIPTION OF THE INVENTION

Figure 1:
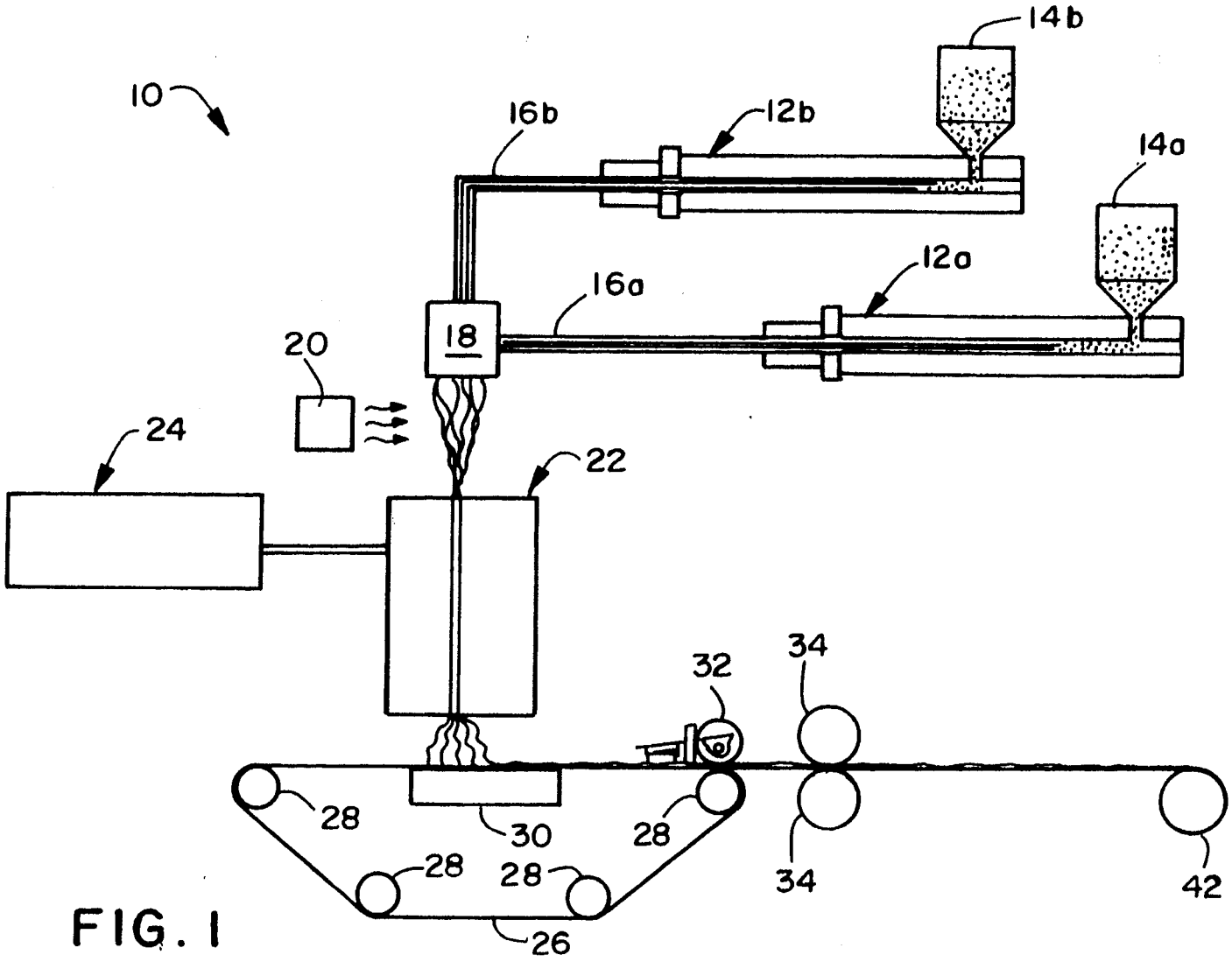
FIG. 1 is a schematic drawing of a process line for making a preferred embodiment of the present invention.

As discussed above, the present invention provides a soft, yet durable, cloth-like nonwoven fabric made with multicomponent polymeric strands. The nonwoven fabric of the present invention comprises extruded multicomponent strands including a blend of a polyolefin and a thermoplastic elastomeric polymer as one of the components. The thermoplastic elastomeric polymer imparts some give to the bond points between the multicomponent strands and thereby enables the fabric to better distribute stress. As a result, the fabric of the present invention has a higher tensile energy and abrasion resistance while maintaining a high level of softness.

The fabric of the present invention is particularly suited for use as an outer cover material for personal care articles and garment materials. Suitable personal care articles include infant care products such as disposable baby diapers, child care products such as training pants, and adult care products such as incontinence products and feminine care products. Suitable garment materials include items such as medical apparel, and work wear, and the like.

In addition, the present invention comprehends a nonwoven composite fabric including a first web of nonwoven fabric including multicomponent polymeric strands as described above and a second web of extruded polymeric strands bonded to the first web in laminar surface-to-surface relationship with the first web. According to a preferred embodiment of the present invention, such a composite material includes a third web of extruded multicomponent polymeric strands bonded to the opposite side of the second web to form a three layer composite. Each layer may include a blend of a polyolefin and a thermoplastic elastomeric polymer for improved overall abrasion resistance of the composite.

The term strand as used herein refers to an elongated extrudate formed by passing a polymer through a forming orifice such as a die. Strands include fibers, which are discontinuous strands having a definite length, and filaments, which are continuous strands of material. The nonwoven fabric of the present invention may be formed from staple multicomponent fibers. Such staple fibers may be carded and bonded to form the nonwoven fabric. Preferably, however, the nonwoven fabric of the present invention is made with continuous spunbond multicomponent filaments which are extruded, drawn, and laid on a traveling forming surface. A preferred process for making the nonwoven fabrics of the present invention is disclosed in detail below.

As used herein, the terms "nonwoven web" and "nonwoven fabric" are used interchangeably to mean a web of material which has been formed without use of weaving processes which produce a structure of individual strands which are interwoven in an identifiable repeating manner. Nonwoven webs may be formed by a variety of processes such as meltblowing processes, spunbonding processes, film aperturing processes and staple fiber carding processes.

The fabric of the present invention includes extruded multicomponent polymeric strands comprising first and second polymeric components. The first and second components are arranged in substantially distinct zones across the cross-section of the multicomponent strands and extend continuously along the length of the multicomponent strands. The second component of the multicomponent strands constitutes a portion of the peripheral surface of the multicomponent strands continuously along the length of the multicomponent strands and includes a blend of a polyolefin and a thermoplastic elastomeric polymer.

Figure 2A:
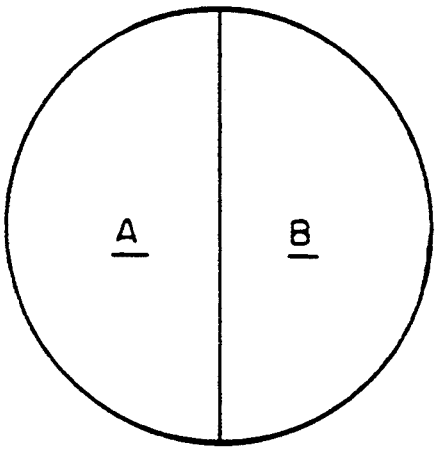
FIG. 2A is a schematic drawing illustrating the cross-section of a filament made according to a preferred embodiment of the present invention with the polymer components A and B in a side-by-side arrangement.
Figure 2B:
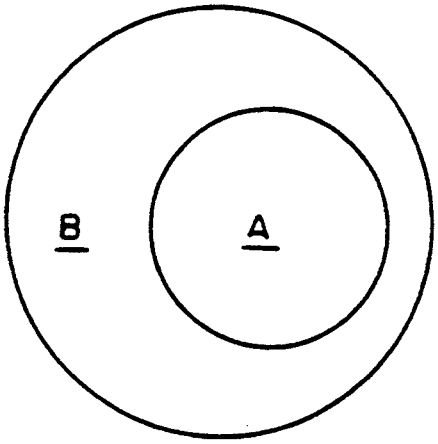
FIG. 2B is a schematic drawing illustrating the cross-section of a filament made according to a preferred embodiment of the present invention with the polymer components A and B in an eccentric sheath/core arrangement.
Figure 2C:
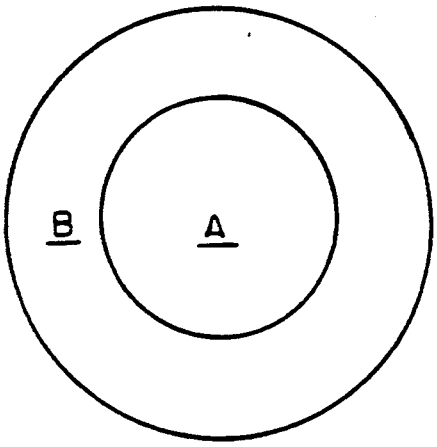
FIG. 2C is a schematic drawing illustrating the cross-section of a filament made according to a preferred embodiment of the present invention with the polymer components A and B in an concentric sheath/core arrangement.

A preferred embodiment of the present invention is a nonwoven polymeric fabric including bicomponent filaments comprising a first polymeric component A and a second polymeric component B. The first and second components A and B may be arranged in a side-by-side arrangement as shown in FIG. 2A or an eccentric sheath/core arrangement as shown in FIG. 2B so that the resulting filaments can exhibit a high level of natural helical crimp. Polymer component A is the core of the strand and polymer B is the sheath of the strand in the sheath/core arrangement. The first and second components may also be formed into a concentric sheath/core arrangement, as shown in FIG. 2C, or other multicomponent arrangements. Methods for extruding multicomponent polymeric strands into such arrangements are well-known to those of ordinary skill in the art. Although the embodiments disclosed herein include bicomponent filaments, it should be understood that the fabric of the present invention may include strands having greater than 2 components.

The first component A of the multicomponent strands preferably has a melting point higher than the second component. More preferably, the first component A includes a polyolefin and the second component includes a blend of a polyolefin and a thermoplastic elastomeric material. Suitable polyolefins for the first component A include polypropylene, random copolymers of propylene and ethylene and poly(4-methyl-1-pentene); however, it should be understood that the first component A may also comprise other thermoplastic polymers such as polyesters or polyamides. Suitable polyolefins for the second component B include polyethylene and random copolymers of propylene and ethylene. Preferred polyethylenes for the second component B include linear low density polyethylene, low density polyethylene, and high density polyethylene.

Preferred combinations of polymers for components A and B include (1) polypropylene as the first component A and a blend of linear low density polyethylene and a thermoplastic elastomeric polymer or compound as the second component B, and (2) polypropylene as the first component A and a blend of a random copolymer of ethylene and propylene and a thermoplastic elastomeric polymer or compound as component B.

Suitable materials for preparing the multicomponent strands of the fabric of the present invention include PD-3445 polypropylene available from Exxon, Houston, Tex., a random copolymer of propylene and ethylene available from Exxon and ASPUN 6811A, 6808A and 6817 linear low density polyethylene available from Dow Chemical Company of Midland, Mich.

Suitable thermoplastic elastomeric polymers include thermoplastic materials that, when formed into a sheet or film and acted on by a bias force, may be stretched to a stretched, biased length which is at least about 125% its relaxed, unbiased length and then will recover at least 25% of its elongation upon release of the stretching, elongating force. The thermoplastic elastomeric polymers have such properties when in their substantially pure form or when compounded with additives, plasticizers, or the like. When blended with a polyolefin in accordance with the present invention, the resulting blend is not elastomeric but does possess some elastomeric properties. A hypothetical example which would satisfy the foregoing definition of elastomeric would be a one inch sample of a material which is capable of being elongated to at least 1.25 inch and which, upon elongated to 1.25 inch in the least, will recover to a length of not more than 1,875 inch.

The term "recover" relates to a contraction of a stretched material upon termination of a biasing force following stretching of the material by application of the biasing force. For example, if a material having a relaxed unbiased length of 1 inch is elongated 50% by stretching to a length of 1½ inch, the material would have been elongated 50% and would have a stretch length that is 150% of its relaxed length. If this stretch material recovered to a length of 1.1" after release of the biasing and stretching force, the material would have recovered 80% of its elongation.

Preferred thermoplastic elastomeric polymers suitable for the present invention include triblock copolymers having the general form A-B-A' wherein A-A' are each a thermoplastic endblock which contains a styrenic moiety such as a poly(vinyl-arene) and wherein B is an elastomeric polymer midblock such as a poly(ethylene-butylene) midblock. The A-B-A' triblock copolymers may have different or the same thermoplastic block polymers for the A and A' blocks and may include linear, branched and radial block copolymers. The radial block copolymers may be designated $(A\text{-}B)_m\text{-}X$, wherein X is a polyfunctional atom or molecule and in which each $(A\text{-}B)_m$-radiates from X so that A is an endblock. In the radial block copolymer, X may be an organic or inorganic polyfunctional atom or molecule and m is an integer having the same value as the functional group originally present in X. The integer m is usually at least 3, and is frequently 4 or 5, but is not limited thereto.

The thermoplastic elastomeric polymers used in the present invention may further include an A-B diblock copolymer wherein A is a thermoplastic endblock comprising a styrenic moiety and B is a poly(ethylene-butylene) block. The thermoplastic elastomeric polymer preferably includes a mixture of the A-B-A' triblock copolymer and the A-B diblock copolymer. The triblock and diblock copolymers suitable for the present invention include all block copolymers having such rubbery blocks and thermoplastic blocks identified above, which can be blended with the polyolefins suitable for the present invention and then extruded as one component of a multicomponent strand.

Preferred thermoplastic elastomeric polymers suitable for the present invention include A-B-A' triblock copolymers available from the Shell Chemical Company under the trademark KRATON. A particular preferred thermoplastic block copolymer compound is available from the Shell Chemical Company under the trademark KRATON G-2740. KRATON G-2740 is a blend including an A-B-A' triblock styrene-ethylene-butylene copolymer, and A-B diblock styrene-ethylene-butylene copolymer, a tackifier, and a viscosity reducing polyolefin. KRATON G-2740 includes 63% by weight of the copolymer mixture, 20% by weight of the viscosity producing polyolefin and 17% by weight of the tackifying resin. The copolymer mixture in KRATON G-2740 includes 70% by weight of the A-B-A' triblock copolymer and 30% by weight of the A-B diblock copolymer. The endblocks A and A' of the triblock and diblock copolymers have a molecular weight of about 5,300. The elastomeric block B of the triblock copolymer has a molecular weight of about 72,000 and the elastomeric block B of the diblock copolymer has a molecular weight of about 36,000.

The tackifying resin in KRATON G-2740 is REGALREZ 1126 hydrogenated hydrocarbon resin available from Hercules, Inc. This type of resin includes alpha-methylstryene and is compatible with the block copolymer mixture of KRATON G-2740 and the polyolefins of the second component B.

The polyolefin wax in KRATON G-2740 is EPOLENE C-10 polyethylene available from the Eastman Chemical Company. Originally, the polyolefin in KRATON G-2740 was polyethylene wax available from Quantum Chemical Corporation, U.S.I. Division of Cincinnati, Ohio, under the trade designation Petrothene NA601 (PE NA601). EPOLENE C-10 and PE NA601 are interchangeable. Information obtained from Quantum Chemical Corporation states that PE NA601 is a low molecular weight, low density polyethylene for application in the areas of hot melt adhesives and coatings. U.S.I. has also stated that PE NA601 has the following nominal values: (1) a Brookfield viscosity, cP at 150° C. of 8,500 and at 190° C. of 3,300 when measured in accordance with ASTM D 3236; (2) a density of 0.903 grams per cubic centimeter when measured in accordance with ASTM D 1505; (3) and equivalent Melt index of 2,000 grams per 10 minutes when measured in accordance with ASTM D 1238; (4) a ring and ball softening point of 102° C. when measured in accordance with ASTM E 28; (5) a tensile strength of 850 pounds per square inch when measured in accordance with ASTM D 638; (6) an elongation of 90% when measured in accordance with ASTM D 638; (7) a modulus of rigidity, $T_F(45,000)$ of −34° C.; and (8) a penetration hardness (tenths of ram) at 77° F. (Fahrenheit) of 3.6.

Although KRATON G-2740 is a preferred mixture of thermoplastic elastomeric polymers, a tackifying resin and a viscosity reducing polyolefin, other such materials may be added to the polyolefin of the second component B. Such materials, however, must be compatible with the polyolefin of the second component B so that the second component B is capable of being extruded along with the first component A to form the multicomponent strands of the present invention. For example, hydrogenated hydrocarbon resins such as Regalrez 1094, 3102, and 6108 may also be used with the present invention. In addition, ARKON P series hydrogenated hydrocarbon resins available from Arakawa Chemical (USA) Inc. are also suitable tackifying resins for use with the present invention. Furthermore, terpene hydrocarbon resins such as ZONATAC 501 Lite is a suitable tackifying resin. Of course, the present invention is not limited to the use of such tackifying resins, and other tackifying resins which are compatible with the composition of component B and can withstand the high processing temperatures, can also be used.

Other viscosity reducers may also be used in the present invention as long as separate viscosity reducers are compatible with component B. The tackifying resin may also function as a viscosity reducer. For example, low molecular weight hydrocarbon resin tackifiers such as, for example, Regalrez 1126 can also act as a viscosity reducer.

While the principle components of the multicomponent strands of the present invention have been described above, such polymeric components can also include other materials which do not adversely affect the objectives of the present invention. For example, the polymeric components A and B can also include, without limitation, pigments, anti-oxidants, stabilizers, surfactants, waxes, flow promoters, solid solvents, particulates and materials added to enhance processability of the composition.

According to a preferred embodiment of the present invention, the multicomponent strands include from about 20 to about 80% by weight of the first polymeric component A and from about 80 to about 20% by weight of the second polymeric component B. The second component B preferably comprises from about 80 to about 95% by weight of a polyolefin and from about 5 to about 20% by weight of the thermoplastic elastomeric polymer. In addition, the second component B preferably further comprises from greater than 0 to about 10% by weight of the tackifying resin and from about 0 to about 10% by weight of the viscosity reducing polyolefin. The thermoplastic elastomeric polymer preferably comprises from about 40 to about 95% by weight of the A-B-A′ triblock copolymer and from about 5 to about 60% by weight of the A-B diblock copolymer.

According to one preferred embodiment of the present invention, a nonwoven fabric includes continuous spunbond bicomponent filaments comprising 50% by weight of a polymeric component A and 50% by weight of a polymeric component B in a side-by-side arrangement, polymeric component A comprising 100% by weight of polypropylene and the polymeric component B comprising 90% polyethylene and 10% KRATON G-2740 thermoplastic elastomeric block copolymer compound. In an alternative embodiment, the polyethylene in the second polymeric component B is substituted with random copolymer of ethylene and propylene.

Turning to FIG. 1, a process line 10 for preparing a preferred embodiment of the present invention is disclosed. The process line 10 is arranged to produce bicomponent continuous filaments, but it should be understood that the present invention comprehends nonwoven fabrics made with multicomponent filaments having more than two components. For example, the fabric of the present invention can be made with filaments having three or four components. Furthermore, the present invention comprehends nonwoven fabrics including single component strands in addition to the multicomponent strands. In such an embodiment, single component and multicomponent strands may be combined to form a single, integral web.

The process line 10 includes a pair of extruders **12*a* and 12*b* for separately extruding a polymer component A and a polymer component B. Polymer component A is fed into the respective extruder 12*a* from a first hopper 14*a* and polymer component B is fed into the respective extruder 12*b* from a second hopper 14*b*. Polymer components A and B are fed from the extruders 12*a* and 12*b* through respective polymer conduits 16*a* and 16*b* to a spinneret 18. Spinnerets for extruding bicomponent filaments are well-known to those of ordinary skill in the art and thus are not described here in detail. Generally described, the spinneret 18 includes a housing containing a spin pack which includes a plurality of plates stacked one on top of the other with a pattern of openings arranged to create flow paths for directing polymer components A and B separately through the spinneret. The spinneret 18 has openings arranged in one or more rows. The spinneret openings form a downwardly extending curtain of filaments when the polymers are extruded through the spinneret. If a high level of crimp is desired, spinneret 18 may be arranged to form side-by-side or eccentric sheath/core bicomponent filaments. Such configurations are shown in FIG. 2A and 2B respectively. If a high level of crimp is not desired, the spinneret 18 may be arranged to form concentric sheath/core bicomponent filaments as shown in FIG. 2C**.

The process line 10 also includes a quench blower 20 positioned adjacent the curtain of filaments extending from the spinneret 18. Air from the quench air blower 20 quenches the filaments extending from the spinneret 18. The quench air can be directed from one side of the filament curtain as shown in FIG. 1, or both sides of the filament curtain.

A fiber draw unit or aspirator 22 is positioned below the spinneret 18 and receives the quenched filaments. Fiber draw units or aspirators for use in melt spinning polymers are well-known as discussed above. Suitable fiber draw units for use in the process of the present invention include a linear fiber aspirator of the type shown in U.S. Pat. No. 3,802,817 and eductive guns of the type disclosed in U.S. Pat. Nos. 3,692,698 and 3,423,266, the disclosures of which patents are incorporated herein by reference.

Generally described, the fiber draw unit 22 includes an elongate vertical passage through which the filaments are drawn by aspirating air entering from the sides of the passage and flowing downwardly through the passage. The aspirating air draws the filaments and ambient air through the fiber draw unit. The aspirating air is heated by a heater 24 when a high degree of natural helical crimp in the filaments is desired.

An endless foraminous forming surface 26 is positioned below the fiber draw unit 22 and receives the continuous filaments from the outlet opening of the fiber draw unit. The forming surface 26 travels around guide rollers 28. A vacuum 30 positioned below the forming surface 26 where the filaments are deposited draws the filaments against the forming surface.

The process line 10 further includes a compression roller 32 which, along with the forward most of the guide rollers 28, receive the web as the web is drawn off of the forming surface 26. In addition, the process line includes a pair of thermal point bonding calender rollers 34 for bonding the bicomponent filaments together and integrating the web to form a finished fabric. Lastly, the process line 10 includes a winding roll 42 for taking up the finished fabric.

To operate the process line 10, the hoppers **14*a* and 14*b* are filled with the respective polymer components A and B. Polymer components A and B are melted and extruded by the respected extruders 12*a* and 12*b* through polymer conduits 16*a* and 16*b* and the spinneret 18**. Although the temperatures of the molten polymers vary depending on the polymers used, when polypropylene and polyethylene are used as components A and B respectively, the preferred temperatures of the polymers range from about 370° to about 500° F. and preferably range from 400° to about 450° F.

As the extruded filaments extend below the spinneret 18, a stream of air from the quench blower 20 at least partially quenches the filaments to develop a latent helical crimp in the filaments. The quench air preferably flows in a direction substantially perpendicular to the length of the filaments at a temperature of about 45° to about 90° F. and a velocity from about 100 to about 400 feet per minute.

After quenching, the filaments are drawn into the vertical passage of the fiber draw unit 22 by a flow of air through the fiber draw unit. The fiber draw unit is preferably positioned 30 to 60 inches below the bottom of the spinneret 18. When filaments having minimal natural helical crimp are desired, the aspirating air is at ambient temperature. When filaments having a high degree of crimp are desired, heated air from the heater 24 is supplied to the fiber draw unit 22. For high crimp, the temperature of the air supplied from the heater 24 is sufficient that, after some cooling due to mixing with cooler ambient air aspirated with the filaments, the air heats the filaments to a temperature required to activate the latent crimp. The temperature required to activate the latent crimp of the filaments ranges from about 110° F. to a maximum temperature less than the melting point of the second component B. The temperature of the air from the heater 24 and thus the temperature to which the filaments are heated can be varied to achieve different levels of crimp. It should be understood that the temperatures of the aspirating air to achieve the desired crimp will depend on factors such as the type of polymers in the filaments and the denier of the filaments.

Generally, a higher air temperature produces a higher number of crimps. The degree of crimp of the filaments may be controlled by controlling the temperature of the air in the fiber draw unit 22 contacting the filaments. This allows one to change the resulting density, pore size distribution and drape of the fabric by simply adjusting the temperature of the air in the fiber draw unit.

Figure 3:
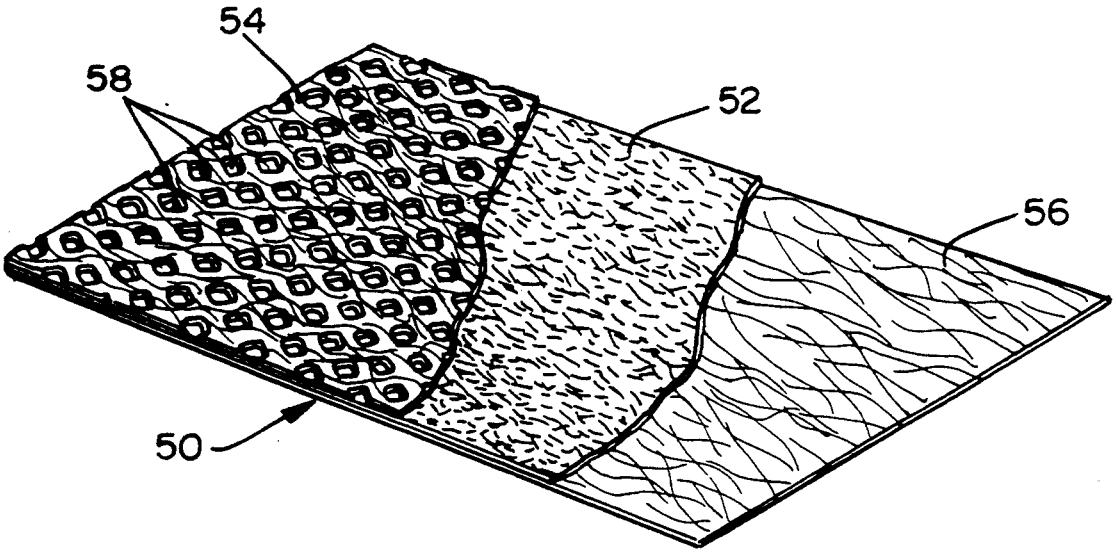
FIG. 3 is a partial perspective view of a point-bonded sample of fabric made according to a preferred embodiment of the present invention.

The drawn filaments are deposited through the outer opening of the fiber draw unit 22 onto the traveling forming surface 26. The vacuum 20 draws the filaments against the forming surface 26 to form an unbonded, nonwoven web of continuous filaments. The web is then lightly compressed by the compression roller 22 and thermal point bonded by bonding rollers 34. Thermal point bonding techniques are well known to those skilled in the art and are not discussed here in detail. Thermal point bonding in accordance with U.S. Pat. No. 3,855,046 is preferred and such reference is incorporated herein by reference. The type of bond pattern may vary based on the degree of fabric strength desired. The bonding temperature also may vary depending on factors such as the polymers in the filaments. As explained below, thermal point bonding is preferred when making cloth-like materials for such uses as the outer cover of absorbent personal care items like baby diapers and as garment material for items like medical apparel. Such a thermal point bonded material as shown in FIG. 3.

Lastly, the finished web is wound onto the winding roller 42 and is ready for further treatment or use. When use to make liquid absorbent articles, the fabric of the present invention may be treated with conventional surface treatments or contain conventional polymer additives to enhance the wettability of the fabric. For example, the fabric of the present invention may be treated with polyalkaline-oxide modified siloxane and silanes such as polyalkaline-dioxide modified polydimethyl-siloxane as disclosed in U.S. Pat. No. 5,057,361. Such a surface treatment enhances the wettability of the fabric so that the fabric is suitable as a liner or surge management material for feminine care, infant care, child care, and adult incontinence products. The fabric of the present invention may also be treated with other treatments such as antistatic agents, alcohol repellents, and the like, as known to those skilled in the art.

The resulting material is soft yet durable. The addition of the thermoplastic elastomeric material enhances the abrasion resistance and give of the fabric without diminishing the softness of the fabric. The thermoplastic elastomeric polymer or compound imparts give to the bond points between the multicomponent filaments enabling the fabric to better distribute stress.

Although the method of bonding shown in FIG. 1 is thermal point bonding, it should be understood that the fabric of the present invention may be bonded by other means such as oven bonding, ultrasonic bonding, hydroentangling or combinations thereof to make cloth-like fabric. Such bonding techniques are well-known to those of ordinary skill in the art and are not discussed here in detail. If a loftier material is desired, a fabric of the present invention may be bonded by non-compressive means such as through-air bonding. Methods of through-air bonding are well-known to those of skill in the art. Generally described, the fabric of the present invention may be through-air bonded by forcing air, having a temperature above the melting temperature of the second component B of the filaments, through the fabric as the fabric passes over a perforated roller. The hot air melts the lower melting polymer component B and thereby forms bonds between the bicomponent filaments to integrate the web. Such a high loft material is useful as a fluid management layer of personal care absorbent articles such as liner or surge materials in a baby diaper.

According to another aspect of the present invention, the above described nonwoven fabric may be laminated to one or more polymeric nonwoven fabrics to form a composite material. For example, an outer cover material may be formed by laminating the spunbond, nonwoven, thermal point bonded fabric described above to a polyethylene film. The polyethylene film acts as a liquid barrier. Such an embodiment is particularly suitable as an outer cover material.

According to another embodiment of the present invention, a first web of extruded multicomponent polymeric strands made as described above is bonded to a second web of extruded polymeric strands, the first and second webs being positioned in laminar surface-to-surface relationship. The second web may be a spunbond material, but for applications such as garment materials for medical apparel, the second layer can be made by well-known meltblowing techniques. The meltblown layer may act as a liquid barrier. Such meltblowing techniques can be made in accordance with U.S. Pat. No. 4,041,203, the disclosure of which is incorporated herein by reference. U.S. Pat. No. 4,041,203 references the following publications on meltblowing techniques which are also incorporated herein by reference: An article entitled "Superfine Thermoplastic Fibers" appearing in INDUSTRIAL & ENGINEERING CHEMISTRY, Vol. 48, No. 8, pp. 1342–1346 which describes work done at the Naval Research Laboratories in Washington, D.C.; Naval Research Laboratory Report 111437, dated Apr. 15, 1954; U.S. Pat. Nos. 3,715,251; 3,704,198; 3,676,242; and 3,595,245; and British Specification No. 1,217,892.

The meltblown layer can comprise substantially the same composition as the second component B of the multicomponent strands in the first web. The two webs are thermal point bonded together to form a cloth-like material. When the first and second webs are bonded together and the thermoplastic elastomeric polymer is present in both the second component B of the multicomponent strands in the first web and the second web, the bonds between the webs are more durable and the composite material has increased abrasion resistance.

Figure 4:
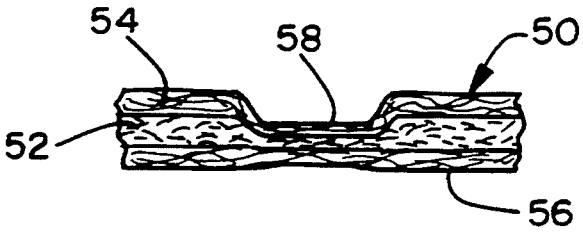
FIG. 4 is a partial perspective view of a multilayer fabric made according to a preferred embodiment of the present invention.

A third layer of nonwoven fabric comprising multicomponent polymeric strands, as in the first web, can be bonded to the side of the second web opposite from the first web. When the second web is a meltblown layer, the meltblown layer is sandwiched between two layers of multicomponent material. Such material 50 is illustrated in FIGS. 3 and 4 and is advantageous as a medical garment material because it contains a liquid penetration resistant middle layer 52 with relatively soft layers of fabric 54 and 56 on each side for better softness and feel. The material 50 is preferably thermal point bonded. When thermal point bonded, the individual layers 52, 54, and 56 are fused together at bond points 58.

Such composite materials may be formed separately and then bonded together or may be formed in a continuous process wherein one web is formed on top of the other. Both of such processes are well-known to those skilled in the art and are not discussed here in further detail. U.S. Pat. No. 4,041,203, which is incorporated herein by reference above, discloses a continuous process for making such composite materials.

The following Examples 1–13 are designed to illustrate particular embodiments of the present invention and to teach one of ordinary skill in the art in the manner of carrying out the present invention. Comparative Examples 1–3 are designed to illustrate the advantages of the present invention. It should be understood by those skilled in the art that the parameters of the present invention will vary somewhat from those provided in the following Examples depending on the particular processing equipment that is used and the ambient conditions.

COMPARATIVE EXAMPLE 1

A nonwoven fabric web comprising continuous bicomponent filaments was made with the process illustrated in FIG. 1 and described above. The configuration of the filaments was concentric sheath/core, the weight ratio of sheath to core being 1:2. The spinhole geometry was 0.6 mm D with an L/D ratio of 4:1 and the spinneret had 525 openings arranged with 50 openings per inch in the machine direction. The core composition was 100% by weight PD-3445 polypropylene from Exxon of Houston, Tex., and the sheath composition was 100% by weight ASPUN 6811A linear low density polyethylene from Dow Chemical Company of Midland, Mich. The temperature of the spin pack was 430° F. and the spinhole throughput was 0.7 GHM. The quench air flow rate was 37 scfm and the quench air temperature was 55° F. The aspirator air temperature was 55° F. and the manifold pressure was 3 psi. The resulting web was thermal point bonded at a bond temperature of 245° F. The bond pattern was characterized by having regularly spaced bond areas with 270 bond points per inch$^2$ and a total bond area of approximately 18%.

EXAMPLE 1

A nonwoven fabric web comprising continuous bicomponent filaments was made in accordance with the process described in Comparative Example 1 except that the sheath comprised 90% by weight ASPUN 6811A polyethylene and 10% by weight KRATON G-2740 thermoplastic elastomeric block copolymer compound from Shell Chemical Company of Houston, Tex.

EXAMPLE 2

A nonwoven fabric web comprising continuous bicomponent filaments was made according to the process described in Comparative Example 1 except that the sheath comprised 80% by weight ASPUN 6811A polyethylene and 20% by weight KRATON G2740 thermoplastic elastomeric block copolymer compound.

EXAMPLE 3

A nonwoven fabric web comprising continuous bicomponent filaments was made according to the process described in Comparative Example 1 except that the sheath comprised 90% by weight random copolymer of propylene and ethylene available from Exxon of Houston, Tex. and 10% by weight of KRATON G2740 thermoplastic elastomeric block copolymer compound.

Fabric samples from Comparative Example 1 and Examples 1–3 were tested to determine their physical properties. The grab tensile was measured according to ASTM D 1682, the Mullen Burst is a measure of the resistance of the fabric to bursting and was measured according to ASTM D 3786, and the drape stiffness was measured according to ASTM D 1388.

The trapezoid tear is a measurement of the tearing strength of fabrics when a constantly increasing load is applied parallel to the length of the specimen. The trapezoid tear was measured according to ASTM D 1117-14 except that the tearing load was calculated as the average of the first and highest peaks recorded rather than of the lowest and highest peaks.

The Martindale Abrasion test measures the resistance to the formation of pills and other related surface changes on textile fabrics under light pressure using a Martindale tester. The Martindale Abrasion was measured according to ASTM 04970-89 except that the value obtained was the number of cycles required by the Martindale tester to create a 0.5 inch hole in the fabric sample.

The cup crush test evaluates fabric stiffness by measuring the peak load required for a 4.5 cm diameter hemispherically shaped foot to crush a 9"×9" piece of fabric shaped into an approximately 6.5 cm diameter by 6.5 cm tall inverted cup while the cup shaped fabric is surrounded by an approximately 6.5 cm diameter cylinder to maintain a uniform deformation of the cup shaped fabric. The foot and the cup are aligned to avoid contact between the cup walls and the foot which might affect the peak load. The peak load is measured while the foot descends at a rate of about 0.25 inches per second (15 inches per minute) utilizing a Model FTD-G-500 load cell (500 gram range) available from the Schaevitz Company, Pennsauken, N.J.

TABLE 1

| | COMPARATIVE EXAMPLE 1 | EXAMPLE 1 | EXAMPLE 2 | EXAMPLE 3 |
|---|---|---|---|---|
| ACTUAL BASIS WEIGHT | 1.01 | 1.15 | 1.20 | 1.14 |
| GRAB TENSILE | | | | |
| MD Peak Energy (in-lb) | 47.30 | 51.99 | 46.46 | 31.22 |
| MD Peak Load (lb) | 20.69 | 20.37 | 20.78 | 25.24 |
| CD Peak Energy (in-lb) | 47.30 | 42.15 | 41.51 | 25.83 |
| CD Peak Load (lb) | 12.77 | 12.77 | 14.49 | 17.92 |
| MD Trapezoid Tear (lb) | 12.90 | 12.60 | 13.90 | 12.50 |
| CD Trapezoid Tear (lb) | 7.70 | 7.70 | 8.90 | 8.10 |
| Martindale Abrasion (cycles/0.5 in. hole) | 82 | 153 | 163 | 231 |
| MD Drape Stiffness (in) | 2.70 | 3.87 | 2.76 | 2.90 |
| CD Drape Stiffness (in) | 1.72 | 1.77 | 1.84 | 2.66 |
| Cup Crush/Peak Load (g) | 55 | 72 | 77 | 128 |
| Cup Crush/Total Energy (g/mm) | 985 | 1339 | 1381 | 2551 |
| Mullen Burst (psi) | 19.70 | 19.08 | 21.20 | 29.40 |

As can be seen from the data in Table 1, the abrasion resistance of samples from Examples 1–2 was significantly greater than the abrasion resistance of Comparative Example 1. This demonstrates the effect of the addition of the thermoplastic elastomeric block copolymer compound to the second component of the multicomponent filaments. The other strength properties of the samples from Examples 1–2, such as grab tensile, trapezoid tear and Mullen Burst, showed that the strength properties were less than, but not substantially different from, the other strength properties of the sample from Comparative Example 1. Likewise, as shown by the drape stiffness and cup crush data in Table 1, the samples from Examples 1–2 had a stiffness not substantially different than that of the sample from Comparative Example 1. This demonstrates that the thermoplastic elastomeric block copolymer compound increases the abrasion resistance and durability of nonwoven multicomponent fabric without appreciably affecting the strength properties and feel of the fabric. The data in Table 1 for the sample from Example 3 illustrates the properties of an embodiment of the present invention wherein the sheath component comprises random copolymer of propylene and ethylene.

COMPARATIVE EXAMPLE 2

A spunbond nonwoven fabric web was made according to the process described in Comparative Example 1 except that ASPUN 6817 polyethylene from Dow Chemical Company was used, the temperature of the spin pack was 460° F., the weight ratio of sheath to core was 1:1, and the spin hole throughput was 0.8 GHM. This spunbond material was thermal point bonded to both sides of a meltblown nonwoven fabric web comprising 100% by weight ASPUN 6814 polyethylene. The meltblown web was made in accordance with U.S. Pat. No. 4,041,203 and the resulting three layer composite was thermal point bonded at a bond temperature of approximately 250° F. with a bond pattern having regularly spaced bond areas with 270 bond points per inch$^2$ and a total bond area of approximately 18%.

EXAMPLE 4

A composite nonwoven fabric was made according to the process described in Comparative Example 2 except that the temperature of the spin pack was 478° F., the temperature of the quench air was 53° F., the sheath of the multicomponent filaments comprised 95% by weight ASPUN 6817 polyethylene from Dow Chemical Company and 5% by weight KRATON G-2740 thermoplastic elastomeric block copolymer compound, and the meltblown web comprised 95% by weight ASPUN 6814 polyethylene from Dow Chemical Company and 5% by weight KRATON G-2740 thermoplastic elastomeric block copolymer compound.

EXAMPLE 5

A composite nonwoven fabric web was made according to the process described in Comparative Example 2 except that the temperature of the melt in the spin pack was 478° F., the temperature of the quench air was 53°

F., the sheath of the multicomponent filaments comprised 90% by weight ASPUN 6817 polyethylene from Dow Chemical Company and 10% by weight G-2740 thermoplastic elastomeric block copolymer compound, and the meltblown web comprised 90% by weight ASPUN 6814 polyethylene from Dow Chemical Company and 10% by weight KRATON G-2740 thermoplastic elastomeric block copolymer compound.

EXAMPLE 6

A composite nonwoven fabric web was made according to the process described in Comparative Example 2 except that the temperature of the spin pack was 470° F., the temperature of the quench air was 52° F., the sheath of the multicomponent filaments comprised 80% by weight ASPUN 6817 polyethylene from Dow Chemical Company and 20% by weight KRATON G-2740 thermoplastic elastomeric block copolymer compound, and the meltblown web comprised 80% by weight ASPUN 6814 polyethylene from Dow Chemical Company and 20% by weight of KRATON G-2740 thermoplastic elastomeric block copolymer compound.

Fabric samples from Comparative Example 2 and Examples 4–6 were tested to determine their physical properties. This data is shown in Table 2, The test methods for producing the data shown in Table 2 were the same as those for producing the test data in Table 1.

TABLE 2

| PROPERTY | COMPARATIVE EXAMPLE 2 | EXAMPLE 4 | EXAMPLE 5 | EXAMPLE 6 |
|---|---|---|---|---|
| ACTUAL BASIS WEIGHT (osy) | 1.60 | 1.60 | 1.67 | 1.64 |
| GRAB TENSILE | | | | |
| MD Peak Load (lb) | 10.35 | 17.81 | 20.89 | 17.68 |
| MD Peak Energy (in-lb) | 17.60 | 39.10 | 38.55 | 34.15 |
| MD % Elongation | 72.91 | 109.11 | 94.24 | 100.48 |
| CD Peak Load (lb) | 9.91 | 12.11 | 17.41 | 16.17 |
| CD Peak Energy (in-lb) | 22.55 | 30.87 | 48.56 | 46.08 |
| CD % Elongation | 108.23 | 133.44 | 152.59 | 154.86 |

As can be seen from Table 2, the addition of the thermoplastic elastomeric copolymer increased not only the abrasion resistance of the composite fabrics but also increased the strength properties of the composite fabrics significantly. For example, the peak load was increased up to about 100% the peak energy was increased up to about 120%, and the elongation was increased up to about 50%.

COMPARATIVE EXAMPLE 3

A nonwoven fabric comprising continuous bicomponent filaments was made according to the process described in Comparative Example 1 except that the weight ratio of sheath to core was 1:1, the sheath comprised 100% by weight 25355 high density polyethylene available from Dow Chemical Company, and the resulting web was thermal point bonded at a bond temperature of 260° F. with a bond pattern having regularly spaced bond areas, 270 bond points per inch$^2$ and a total bond area of about 18%.

EXAMPLE 7

A nonwoven fabric comprising continuous bicomponent filaments was made in accordance with the process described in Comparative Example 3 except that the sheath comprised 90% by weight 25355 high density polyethylene and 10% by weight KRATON G-2740 thermoplastic elastomeric block copolymer compound.

EXAMPLE 8

A nonwoven fabric comprising continuous bicomponent filaments was made according to the process described in Comparative Example 3 except that the sheath comprised 85% by weight 25355 high density polyethylene and 15% by weight KRATON G-2740 thermoplastic elastomeric block copolymer compound.

EXAMPLE 9

A nonwoven fabric comprising continuous bicomponent filaments was made according to the process described in Comparative Example 3 except that the sheath comprised 80% by weight 25355 high density polyethylene and 20% by weight KRATON G-2740.

EXAMPLE 10

A nonwoven fabric comprising continuous bicomponent filaments was made according to the process described in Example 8. This material was thermal point bonded to both sides of a meltblown nonwoven fabric web comprising 100% by weight ASPUN 25355 linear low density polyethylene from Dow Chemical Company suitable for meltblown webs. The meltblown web was made in accordance with U.S. Pat. No. 4,041,203 and the resulting three layer composite was thermal point bonded at a temperature of 260° F. with a bond pattern having regularly spaced bond areas, 270 bond points per square inch and a total bond area of about 18%.

EXAMPLE 11

A composite nonwoven fabric was made according to the process described in Example 10 except that the meltblown web comprised 100% by weight 3495G polypropylene from Exxon.

Fabric samples from Comparative Example 3 and Examples 7–11 were tested to determine their physical properties. The data were obtained using the same methods described above with regard to Comparative Example 1. These data are shown in Table 3.

TABLE 3

| PROPERTY | COMPARATIVE EXAMPLE 3 | EXAMPLE 7 | EXAMPLE 8 | EXAMPLE 9 | EXAMPLE 10 | EXAMPLE 11 |
|---|---|---|---|---|---|---|
| ACTUAL BASIS WEIGHT | 1.11 | 1.20 | 1.12 | 1.26 | 1.58 | 1.49 |
| GRAB TENSILE | | | | | | |

TABLE 3-continued

| PROPERTY | COMPARATIVE EXAMPLE 3 | EXAMPLE 7 | EXAMPLE 8 | EXAMPLE 9 | EXAMPLE 10 | EXAMPLE 11 |
|---|---|---|---|---|---|---|
| MD/CD Average Peak Energy (in-lb) | 34.82 | 42.27 | 41.95 | 53.30 | 38.24 | 22.55 |
| MD/CD Average Peak Load (lb) | 11.50 | 12.50 | 12.60 | 14.20 | 12.70 | 8.09 |
| MD Trapezoid Tear (lb) | 10.64 | 12.34 | 10.65 | 10.73 | 12.43 | 10.94 |
| CD Trapezoid Tear (lb) | 4.67 | 5.15 | 6.17 | 6.10 | 5.66 | 3.27 |
| Martindale Abrasion (cycles/0.5 in. hole) | 289 | 356 | 487 | 1041 | 307 | 403 |
| Mullen Burst (psi) | 19.9 | 19.9 | 20.3 | 21.2 | 20.6 | 21.10 |
| MD Drape Stiffness (in) | 2.83 | 2.53 | 2.66 | 2.72 | 2.96 | 2.57 |
| CD Drape Stiffness (in) | 1.60 | 1.37 | 1.30 | 1.47 | 1.33 | 1.55 |
| Cup Crush/ Peak Load (g) | 57 | 43 | 44 | 58 | 66 | 89 |
| Cup Crush/ Total Energy (g/mm) | 1025 | 794 | 871 | 1054 | 1209 | 1628 |

The data in Table 3 for the samples from Comparative Example 3 and Examples 7–9 are consistent with the data from Tables 1 and 2 in that the addition of the thermoplastic elastomer block copolymer increases the abrasion resistance of the fabric without diminishing the strength properties or softness of the fabric. The samples from Examples 10 and 11 were composite fabrics and cannot be compared directly to the other samples illustrated in Table 3. The data for the samples from Examples 10 and 11 are included to illustrate the properties of composite fabrics made according to certain embodiments of the present invention.

EXAMPLE 12

A composite nonwoven fabric was made according to the process described in Example 10 except that the sheath in the outer layer comprised 85% by weight 6811A polyethylene from Dow Chemical Company and 15% by weight KRATON G-2740 thermoplastic elastomeric block copolymer.

EXAMPLE 13

A composite nonwoven fabric was made according to the process described in Example 10 except that the sheath in the outer layers comprised 85% by weight 6811A polyethylene from Dow Chemical Company and 15% by weight KRATON G-2740 thermoplastic elastomeric block copolymer, and the meltblown layer comprised 100% by weight PD3445 polypropylene from Exxon.

Fabric samples from Examples 12 and 13 were tested according to the methods identified above and the results are shown in Table 4.

TABLE 4

| Property | EXAMPLE 12 | EXAMPLE 13 |
|---|---|---|
| ACTUAL BASIS WEIGHT | 1.88 | 1.69 |

TABLE 4-continued

| Property | EXAMPLE 12 | EXAMPLE 13 |
|---|---|---|
| GRAB TENSILE | | |
| MD/CD Average Peak Energy (in-lb) | 44.68 | 28.18 |
| MD/CD Average Peak Load (lb) | 16.02 | 12.86 |
| MD Trapezoid Tear (lb) | 15.55 | 11.02 |
| CD Trapezoid Tear (lb) | 6.15 | 4.67 |
| Martindale Abrasion (cycles/0.5 in hole) | 1002 | 385 |
| Mullen Burst (psi) | 21.6 | 22.8 |
| MD Drape Stiffness (in) | 2.44 | 3.95 |
| CD Drape Stiffness (in) | 1.65 | 1.84 |
| Cup Crush/ Peak Load (g) | 108 | 131 |
| Cup Crush/ Total Energy (g/mm) | 1879 | 2382 |

The data in Table 4 demonstrate the high level of abrasion resistance of composite materials including thermoplastic elastomeric block copolymer. Example 12 indicates that a composite with polyethylene in the middle meltblown layer and the sheath component of the bicomponent materials yields a more abrasion resistant material than when the meltblown layer comprises polypropylene.

While the invention has been described in detail with respect to specific embodiments thereof, it will be appreciated that those skilled in the art, upon attaining an understanding of the foregoing, may readily conceive of alterations to, variations of and equivalents to these embodiments. Accordingly, the scope of the present invention should be assessed as that of the appended claims and any equivalents thereto.

We claim:

1. A nonwoven fabric comprising extruded multicomponent polymeric strands including first and second polymeric components, the multicomponent strands having a cross-section, a length, and a peripheral surface, the first and second components being arranged in substantially distinct zones across the cross-section of the multicomponent strands and extending continuously along the length of the multicomponent strands, the second component constituting at least a portion of the peripheral surface of the multicomponent strands continuously along the length of the multicomponent strands and including a blend of a polyolefin and a thermoplastic elastomeric polymer.

2. A nonwoven fabric as in claim 1 wherein the thermoplastic elastomeric polymer is present in an amount from about 5 to about 20% by weight of the second component and the polyolefin is present in an amount from about 80 to about 95% by weight of the second component.

3. A nonwoven fabric as in claim 1 wherein the thermoplastic elastomeric polymer comprises an A-B-A' triblock copolymer wherein A and A' are each a thermoplastic endblock comprising a styrenic moiety and B is an elastomeric poly(ethylene-butylene) midblock.

4. A nonwoven fabric as in claim 3 wherein the blend further comprises a tackifying resin.

5. A nonwoven fabric as in claim 4 wherein the tackifying resin is selected from the group consisting of hydrogenated hydrocarbon resins and terpene hydrocarbon resins.

6. A nonwoven fabric as in claim 5 wherein the tackifying resin is alpha methyl styrene.

7. A nonwoven fabric as in claim 4 wherein the blend further comprises a viscosity reducing polyolefin.

8. A nonwoven fabric as in claim 7 wherein the viscosity reducing polyolefin is a polyethylene wax.

9. A nonwoven fabric as in claim 3 wherein the thermoplastic elastomeric polymer further comprises an A-B diblock copolymer wherein A is a thermoplastic endblock comprising a styrenic moiety and B is an elastomeric poly(ethylene-butylene) block.

10. A nonwoven fabric as in claim 9 wherein the blend further comprises a tackifying resin.

11. A nonwoven fabric as in claim 10 wherein the tackifying resin is selected from the group consisting of hydrogenated hydrocarbon resins and terpene hydrocarbon resins.

12. A nonwoven fabric as in claim 10 wherein the tackifying resin is alpha methyl styrene.

13. A nonwoven fabric as in claim 10 wherein the blend further comprises a viscosity reducing polyolefin.

14. A nonwoven fabric as in claim 13 wherein the viscosity reducing polyolefin is a polyethylene wax.

15. A nonwoven fabric as in claim 1 wherein the strands are continuous filaments.

16. A nonwoven fabric as in claim 1 wherein the polyolefin of the second component is selected from the group consisting of polyethylene, polypropylene, and copolymers of ethylene and propylene.

17. A nonwoven fabric as in claim 1 wherein the polyolefin of the second component comprises linear low density polyethylene.

18. A nonwoven fabric as in claim 1 wherein the first component has a first melting point and the second component has a second melting point less than the first melting point.

19. A nonwoven fabric as in claim 1 wherein the first component has a first melting point and the second component has a second melting point less than the first melting point, the second component comprising polyethylene.

20. A nonwoven fabric as in claim 1 wherein the first component has a first melting point and the second component has a second melting point less than the first melting point, the second component comprising linear low density polyethylene.

21. A nonwoven fabric as in claim 1 wherein the first component has a first melting point and the second component has a second melting point less than the first melting point, the first component comprising a polyolefin.

22. A nonwoven fabric as in claim 1 wherein the first component has a first melting point and the second component has a second melting point less than the first melting point, the first component being selected from the group consisting of polypropylene and copolymers of propylene and ethylene, and the second component comprising polyethylene.

23. A nonwoven fabric as in claim 1 wherein the first component has a first melting point and the second component has a second melting point less than the first melting point, the first component being selected from the group consisting of polypropylene and copolymers of propylene and ethylene, and the second component comprising linear low density polyethylene.

24. A nonwoven fabric as in claim 1 wherein the first component has a first melting point and the second component has a second melting point less than the first melting point, the first component comprising polypropylene and the second component comprising random copolymers of propylene and ethylene.

25. A nonwoven fabric as in claim 1 wherein:

the first polymeric component is present in an amount from about 20 to about 80% by weight of the strands and the second polymeric component is present in an amount from about 80 to about 20% by weight of the strands;

the thermoplastic elastomeric polymer is present in an amount from about 5 to about 20% by weight of the second component and the polyolefin is present in an amount from about 80 to about 95% by weight of the second component; and the thermoplastic elastomeric polymer comprises an A-B-A' triblock copolymer wherein A and A' are each a thermoplastic endblock comprising a styrenic moiety and B is an elastomeric poly(ethylene-butylene) midblock.

26. A nonwoven fabric as in claim 25 wherein the thermoplastic elastomeric polymer comprises from about 40 to about 95% by weight of the A-B-A' triblock copolymer, and from about 5 to about 60% by weight of an A-B diblock copolymer wherein A is a thermoplastic endblock comprising a styrenic moiety and B is an elastomeric poly(ethylene-butylene) block.

27. A nonwoven fabric as in claim 25 wherein the blend further comprises from greater than 0 to about 10% by weight a tackifying resin.

28. A nonwoven fabric as in claim 25 wherein the blend further comprises from greater than 0 to about 10% by weight of a viscosity reducing polyolefin.

29. A nonwoven fabric as in claim 25 wherein the blend further comprises from greater than 0 to about 10% by weight a tackifying resin and from greater than 0 to about 10% by weight of a viscosity reducing polyolefin.

30. A nonwoven fabric as in claim 25 wherein the first component comprises polypropylene and the second component comprises polyethylene.

31. A nonwoven fabric as in claim 25 wherein the first component comprises polypropylene and the second component comprises random copolymer of propylene and ethylene.

32. A personal care article comprising a layer of nonwoven fabric comprising extruded multicomponent polymeric strands including first and second polymeric components, the multicomponent strands having a cross-section, a length, and a peripheral surface, the first and second components being arranged in substantially distinct zones across the cross-section of the multicomponent strands and extending continuously along the length of the multicomponent strands, the second component constituting at least a portion of the peripheral surface of the multicomponent strands continuously along the length of the multicomponent strands and including a blend of a polyolefin and a thermoplastic elastomeric polymer.

33. A personal care article as in claim 32, wherein the thermoplastic elastomeric polymer comprises an A-B-A′ triblock copolymer wherein A and A′ are each a thermoplastic endblock comprising a styrenic moiety and B is an elastomeric poly(ethylene-butylene) midblock.

* * * * *

UNITED STATES PATENT AND TRADEMARK OFFICE

CERTIFICATE OF CORRECTION

PATENT NO. : 5,405,682

DATED : April 11, 1995

INVENTOR(S) : Susan E. Shawver, et al.

It is certified that error appears in the above-identified patent and that said Letters Patent is hereby corrected as shown below:

Column 7, line 51, "than 1,875 inch." should read --than 1.875 inch.--;

Column 17, line 25, "in Table 2, The" should read --in Table 2. The--;

On title page, item [19], "Shawyer et al." should read --Shawver et al. --;

item [76], "Susan E. Shawyer" should read --Susan E. Shawver--.

Signed and Sealed this

Thirtieth Day of April, 1996

*Attest:*

*Attesting Officer*

Bruce Lehman

BRUCE LEHMAN

*Commissioner of Patents and Trademarks*